US010964295B1

(12) United States Patent
Myers

(10) Patent No.: US 10,964,295 B1
(45) Date of Patent: Mar. 30, 2021

(54) GUITAR PICK STICK

(71) Applicant: Daniel Myers, Moreno Valley, CA (US)

(72) Inventor: Daniel Myers, Moreno Valley, CA (US)

( * ) Notice: Subject to any disclaimer, the term of this patent is extended or adjusted under 35 U.S.C. 154(b) by 0 days.

(21) Appl. No.: 16/850,445

(22) Filed: Apr. 16, 2020

Related U.S. Application Data

(60) Provisional application No. 62/945,993, filed on Dec. 10, 2019.

(51) Int. Cl.
*G10D 3/173* (2020.01)

(52) U.S. Cl.
CPC ..... *G10D 3/173* (2020.02)

(58) Field of Classification Search
CPC ..... G10D 3/173
See application file for complete search history.

(56) References Cited

U.S. PATENT DOCUMENTS

| | | | | | |
|---|---|---|---|---|---|
| 1,490,407 | A | | 1/1893 | Eisenbrandt | |
| 555,599 | A | * | 3/1896 | Essig | G10D 3/173 84/322 |
| 606,222 | A | * | 6/1898 | Lorenz et al. | G10D 3/173 84/320 |
| 628,851 | A | * | 7/1899 | Reed | G10D 3/173 84/320 |
| 677,584 | A | * | 7/1901 | Mitchell | G10D 3/173 84/320 |
| 796,878 | A | * | 8/1905 | Spurgeon | G10D 3/173 84/320 |
| 1,593,809 | A | | 7/1926 | Vana | |
| 1,653,241 | A | | 12/1927 | Vana | |
| 1,784,934 | A | * | 12/1930 | Johansson | G10D 3/173 84/322 |
| 2,052,405 | A | * | 8/1936 | Keller | A63H 5/00 446/418 |
| 2,550,276 | A | * | 4/1951 | Lenz | G10D 3/173 84/321 |
| 5,320,019 | A | | 6/1994 | McCaw | |
| 7,622,662 | B2 | | 11/2009 | Shaper et al. | |
| D637,223 | S | | 5/2011 | King | |
| 8,097,798 | B2 | * | 1/2012 | McDonald | G10D 3/173 84/315 |
| 8,193,431 | B1 | * | 6/2012 | Engler | G10D 3/173 84/322 |

(Continued)

*Primary Examiner* — Robert W Horn
(74) *Attorney, Agent, or Firm* — Kirk A. Buhler; Buhler & Associates Patenting

(57) ABSTRACT

Improvements in stringed instrument playing tool is disclosed. The guitar pick stick has curved and flat surfaces that allows the tool to strike one or multiple strings using the curved surface or to strike multiple strings using the side of the curved surface to reach end strings or all of the strings on the instrument. The end can be pointed, fanned or have other shapes that further be used to pick or strum individual strings. Using the different areas can produce different sounds and in addition, striking the strings at different locations along the length of the strings can produce different tonal effects. A raised area can exist in the center or off-center of the guitar pick stick and allows the user to rub the raised area of the guitar pick stick across one or a variety of strings to provide a different acoustical sound.

20 Claims, 5 Drawing Sheets

(56) References Cited

U.S. PATENT DOCUMENTS

| | | | | |
|---|---|---|---|---|
| 8,222,505 | B1 * | 7/2012 | Bodnar | G10D 3/173 84/320 |
| 8,263,845 | B2 * | 9/2012 | McDonald | G10D 3/173 84/315 |
| D672,385 | S | 12/2012 | Goad | |
| 10,210,848 | B1 * | 2/2019 | Falcon | G10D 3/173 |

* cited by examiner

GUITAR PICK STICK

CROSS REFERENCE TO RELATED APPLICATIONS

This application claims the benefit of Provisional Application Ser. No. 62/945,993 filed May 10, 2019 the entire contents of which is hereby expressly incorporated by reference herein.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

Field of the Invention

This invention relates to improvements in a guitar playing instrument. More particularly, the present guitar pick stick allows a player to play the stringed instrument with a variety of different techniques as might be found with a hammer or Tympani stick.

Description of Related Art Including Information Disclosed Under 37 CFR 1.97 and 1.98

Stringed instruments are typically played with a bow, pick or fingers. With the use of a bow the user draws the bow across the strings to play a single string or two strings and the strings are set in a curved relationship around the neck of the instrument. Another way to play an instrument is with a pick that allows a user to sequentially strum individual springs as well as "picking" a singular string. A performer can also pluck one or a plurality of strings or strums the strings, using fingernails or fingertips. These different methods of playing limit some playing techniques due to the limitation of the device or fingers that are in contact with the strings. A number of patents and or publications have been made to address these issues. Exemplary examples of patents and or publication that try to address this/these problem(s) are identified and discussed below.

U.S. Pat. No. 490,407 issued on Jan. 24, 1893 to C. H. Eisenbrandt is titled Hammer for Autoharps. This patent discloses a flat hammer whereby a user can strike multiple strings on an autoharp. While this patent is for a hammer device were multiple strings can be struck, the flat nature of the hammer only allows for all of the strings or for strings on one-side or the other of the autoharp to be struck.

U.S. Pat. No. 7,622,662 issued on Jan. 24, 1893 to Thomas O. Shaper et al. is titled String Percussion Instrument. This patent discloses an instrument having a body, a neck and a plurality of strings connected between the body and neck. The body and neck have a top surface. The top surface of the neck is offset by some angle relative to the top surface of the body to allow the strings to be struck with a hammer. While this patent discloses an instrument with a hammer, the hammer has a rounded ball that can only strike one or possibly two strings.

U.S. Pat. No. 8,193,431 issued on Jun. 5, 2012 to Mark Engler is titled Guitar Hammer and Method. This patent discloses a hand-held hammer for playing a guitar includes a handle, an arm and a head. The head has a head longitudinal axis and a striking surface that is generally transverse to the longitudinal axis of the arm. The striking surface is curved and equal to or longer than the distance between the first and fourth string of a six-string guitar. The player holds the guitar, selects the string length by fretting one or more strings, grips the hammer by the handle and strikes the strings with the striking surface. In this patent the guitar is hand-held and is not used with a common guitar that is held in-front of a user.

What is needed is a guitar playing stick that allows the player several different ways to play the guitar. The guitar pick stick disclosed in this document provides the solution.

BRIEF SUMMARY OF THE INVENTION

It is an object of the guitar pick stick strike the strings of a guitar to be held in or across or within the palm of the player's hand. The guitar pick stick can be held like a drum stick between the thumb and palm where it can strike straight down upon the strings or across the palm. The guitar pick stick can also be held that allows the stick to bounce on the strings as the stick movement is partially absorbed by the user's hand.

It is an object of the guitar pick stick to have multiple surfaces to provide different playing techniques and sounds. The guitar pick stick has curved and flat surfaces that allows the guitar pick stick to strike one or multiple strings using the curved surface or to strike multiple strings using the side of the curved surface to reach end strings or all of the strings on the instrument. The end of the guitar pick stick can be pointed, fanned or have other shapes that can be used to pick or strum individual strings without requiring the user use their hands. Using the different areas of the guitar pick stick can produce different sounds and in addition, striking the strings at different locations along the length of the strings can produce different tonal effects.

It is another object of the guitar pick stick to have a raised surface or point that can be drawn over the string. The raised area can exist in the center or off-center of the guitar pick stick and allows the user to rub the raised area of the guitar pick stick across one or a variety of strings to provide a different acoustical sound.

It is another object of the guitar pick stick to be formed from flat material where the shape can be routed to include a picking nub and tactile holes that a user can feel to identify a position of the guitar pick stick in their hand without visually looking. The routed shape can also include the curves to allow the guitar pick stick to strike one or a plurality of strings to obtain a desired acoustical sound.

It is still another object of the guitar pick stick to be used on a variety of stringed instruments. While the guitar pick stick was originally intended for use on a steel string guitar, the guitar pick stick can be used on different instruments and with instruments having different string materials including, but not limited to violins, harps, cello and can further be used on percussion instruments.

Various objects, features, aspects, and advantages of the present invention will become more apparent from the following detailed description of preferred embodiments of the invention, along with the accompanying drawings in which like numerals represent like components.

BRIEF DESCRIPTION OF THE SEVERAL VIEWS OF THE DRAWING(S)

DETAILED DESCRIPTION OF THE INVENTION

Figure 1:
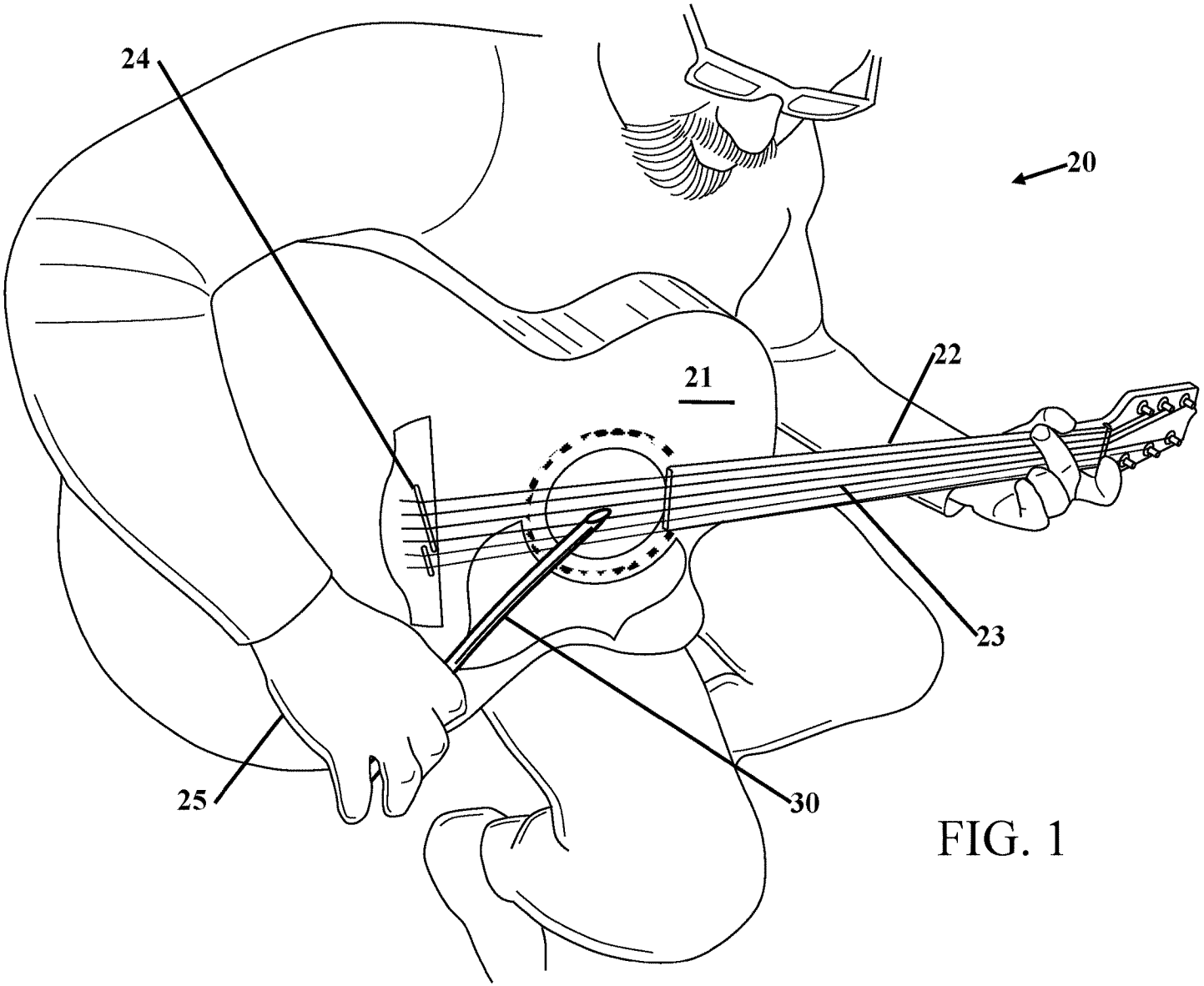
FIG. 1 shows a guitar pick stick in an environment of use.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, but is merely representative of various embodiments of the invention. The illustrated embodiments of the invention will be best understood by reference to the drawings, wherein like parts are designated by like numerals throughout.

ITEM NUMBERS AND DESCRIPTION

20 user
21 guitar
22 guitar neck
23 guitar string(s)
24 guitar bridge
25 hand
26 string bend
27 strings
30 guitar pick stick
31 rounded body
32 taper
33 tip
34 radius about 8"
35 nub
36 thumb locator
37 holes
38 curved end
40 flattened body
41 flattened body
42 taper
43 tip
44 radius about 3/16
45 radius
46 radius
47 radius
48 round
96 side-to-side
97 strike
98 strike
99 pick FIG. 1 shows a guitar pick stick 30 in an environment of use. In this figure, the user 20 or performer is shown with a guitar 21 resting on the user's 20 knee. This is a typical configuration for a user 20 holding and playing a guitar 21 as they hold the neck 22 and press the strings 23 with one hand. In this embodiment, the user 20 is holding the guitar pick stick 30 in their hand 25 as they play strike the strings 23 of the guitar with the guitar pick stick 30. Using the guitar pick stick 30 to strike the strings 23 in proximity of the guitar bridge 24 can alter the sound from the instrument. While this embodiment shows the guitar pick stick 30 being used on a guitar, it should be understood that using the guitar pick stick 30 is not limited to a guitar, and can be used on nearly any stringed instrument where the guitar pick stick 30 is used as a percussion type instrument to strike the strings 23.

Depending upon the grip of the user's hand 25 on the guitar pick stick 30, the result can be a single sound of one or more strings, or the guitar pick stick 30 can bounce on the string(s) 23 to provide a different sound or tonal quality. The curved surfaces and ends of the guitar pick stick 30 can also be used to allow the user to use the guitar pick stick 30 to play the instrument in a variety of ways. While the guitar pick stick was originally intended for use on a steel string guitar, the guitar pick stick can be used on different instruments and with instruments having different string materials including, but not limited to violins, harps, cello and can further be used on percussion instruments. Some of the different playing techniques and uses of the guitar pick stick 30 on a stringed instrument is shown and described in other figures herein.

Figure 2:
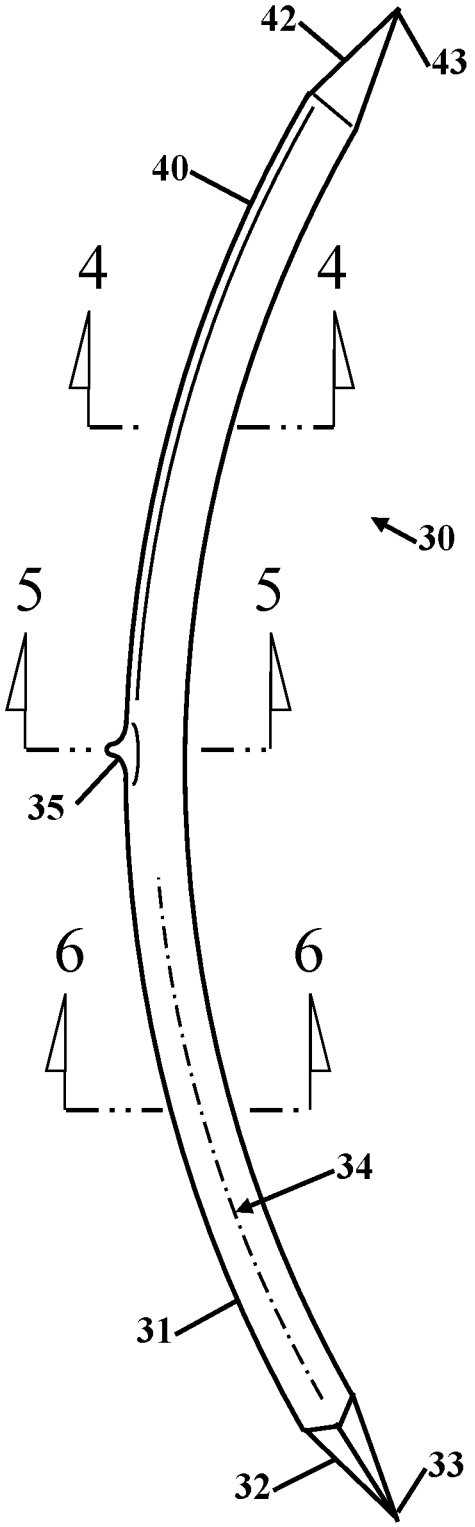
FIG. 2 shows a side view of the guitar pick stick.
Figure 3:
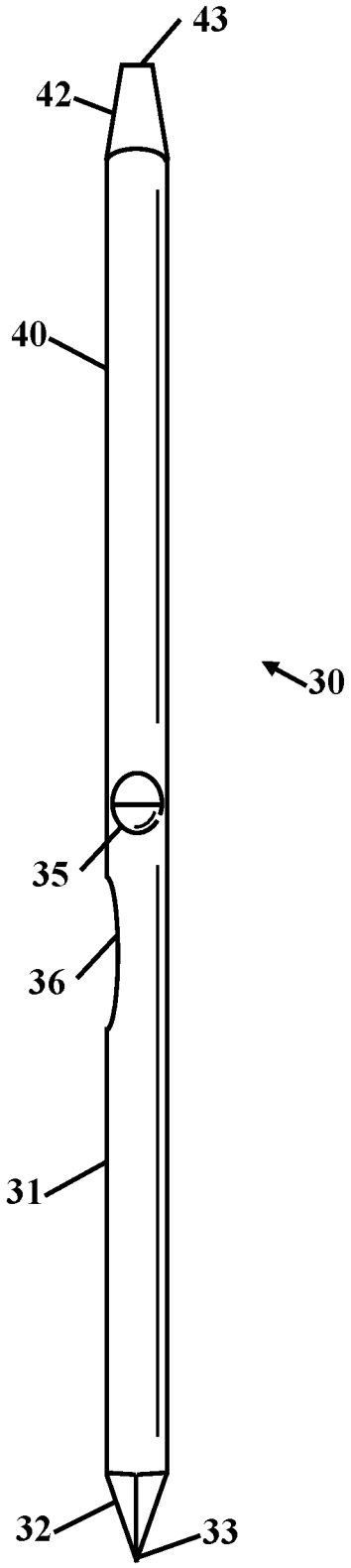
FIG. 3 shows a top view of the guitar pick stick.

FIG. 2 shows a side view of the guitar pick stick 30 and FIG. 3 shows a top view of the guitar pick stick 30. The guitar pick stick 30 is curved to allow the user to grasp the guitar pick stick 30 and strike the strings without contacting the body of the guitar with their hand as they play. The radius 34 of curvature is about a 9-inch radius, but a radius of between 6 and 18 inches can be used. The different radius changes the number of strings that are contacted when the guitar pick stick 30 strikes the strings. The guitar pick stick 30 is essentially flat in the top view, and a performer can rotate the guitar pick stick 30 from vertical to alter the effective radius that contacts the strings. The overall length of the guitar pick stick 30 is between 6 and 18 inches The guitar pick stick 30 has a nub 35 that separates the flattened body portion 40 from the rounded body portion 31. The nub 35 is shown at about the center of the guitar pick stick 30 but can exist in a location that is favored to either side of the guitar pick stick 30. The nub 35 is elevated slightly from the body of the guitar pick stick 30 to an elevation of between 1/16 to 3/16 of an inch. One side of the guitar pick stick 30 has a thumb locator 36 or recess that provides a flat surface for both locating the thumb and preventing rotation of the guitar pick stick 30 when striking the strings. The ends of the guitar pick stick 30 are shown with different termination details. One end has a taper 42 with a blade shaped tip 43, while the other end shows a taper 32 with a tip 33. It is also contemplated that one or both ends can have interchangeable shapes or picks to perform other playing variations and techniques on the instrument. A number of cross-sectional views are taken from FIG. 2 to show the shape of the guitar pick stick 30.

Figure 4:
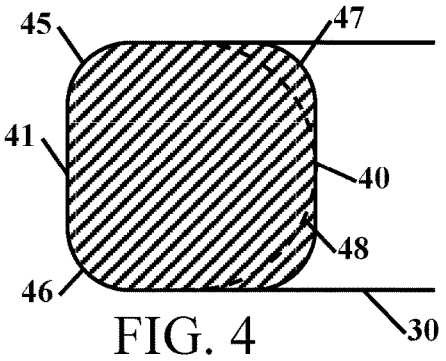
FIG. 4 shows a sectional view taken along lines 4-4 from FIG. 2.

FIG. 4 shows a sectional view taken along lines 4-4 from FIG. 2. This portion of the guitar pick stick 30 has a flattened body 41 surface with radius sides 45 and 46. The radius sides 45 and/or 46 can be smooth or one can be scalloped to drag against the strings like a bow to create a different sounds or tones. The flattened body 40 can be minimal to impact the strings, and in the figure the sides of the flattened body 40 also have a flattened surface. The back side of the cross-section can be rounded 48 or flattened with a radius 47. The different sides and radius allow the player to strike the strings with different surfaces that can result in differing sounds.

Figure 5:
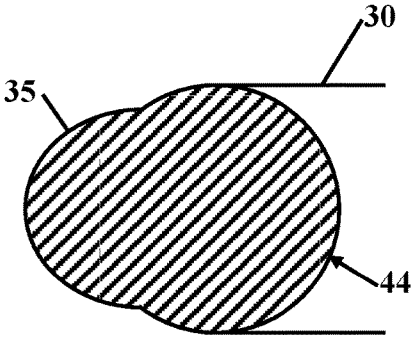
FIG. 5 shows a sectional view taken along lines 5-5 from FIG. 2.

FIG. 5 shows a sectional view taken along lines 5-5 from FIG. 2. This cross-section shows that the nub 35 is elevated slightly from the body of the guitar pick stick 30 to an elevation of between 1/16 to 3/8 of an inch from the radius 44 of the guitar pick stick 30. The radius 44 of the guitar pick stick 30 is between 1/4 to 3/4 inch in diameter, with the preferred diameter being about 3/8 inch in diameter. The elevated nub 35 can be used to rapidly or slowly be drawn across the strings of the instrument to create a particular sound. As the nub 35 is drawn over a string it essentially will "pluck" the string. The nub 35 is shown at about the center of the guitar pick stick 30 but can exist in a location that is favored to either side of the guitar pick stick 30.

Figure 6:
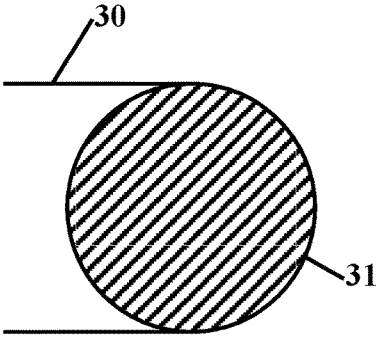
FIG. 6 shows a sectional view taken along lines 6-6 from FIG. 2.

FIG. 6 shows a sectional view taken along lines 6-6 from FIG. 2. The guitar pick stick 30 is shown with the rounded body 31 that a user can grasp or the user can grasp the opposite end of the guitar pick stick 30 and strike the strings with the rounded body 31. The rounded body 31 of the guitar pick stick 30 is between 1/4 to 3/4 inch in diameter, with the preferred diameter being about 3/8 inch in diameter.

Figure 7:
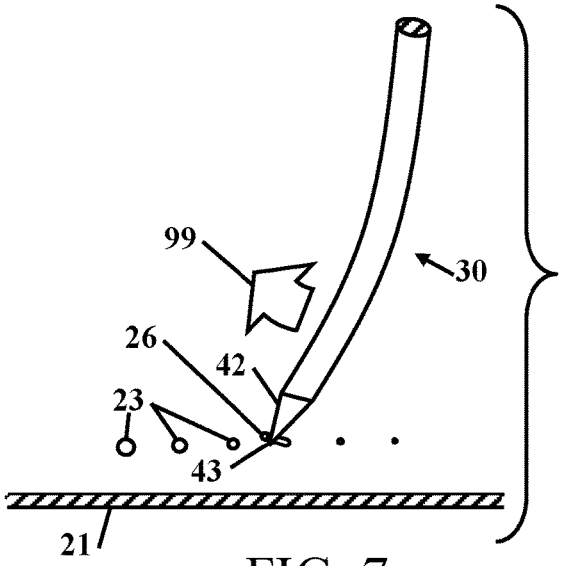
FIG. 7 shows a side of the guitar pick stick plucking a single string.

FIG. 7 shows a side of the guitar pick stick 30 plucking a single string 23. The strings 23 are shown above the guitar 21 soundboard. The tip 43 of the taper 42 of the guitar pick stick 30 is shown in contact with a single string 26 that is being bent 99 with the guitar pick stick 30 to pick the string with the remaining strings 23 are undisturbed.

Figure 8:
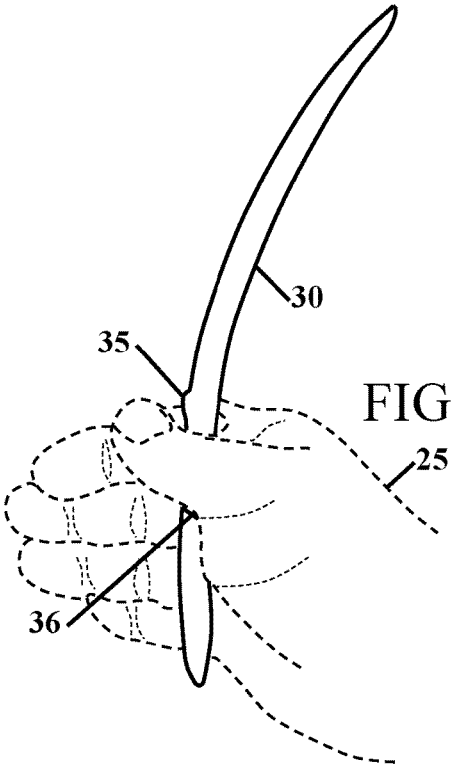
FIG. 8 shows the guitar pick stick being held in and hand with the thumb in the thumb locator.

FIG. 8 shows the guitar pick stick 30 being held in and hand 25 with the thumb in the thumb locator 36. The nub 35 is located above the thumb locator 36. This is a typical orientation of the guitar pick stick 30 in a user's hand 25. The guitar pick stick 30 can have two or more radius of curvature with one curvature above the nub 35 and another, straighter, curvature of from the nub 35 into the hand 25 of the user.

Figure 9:
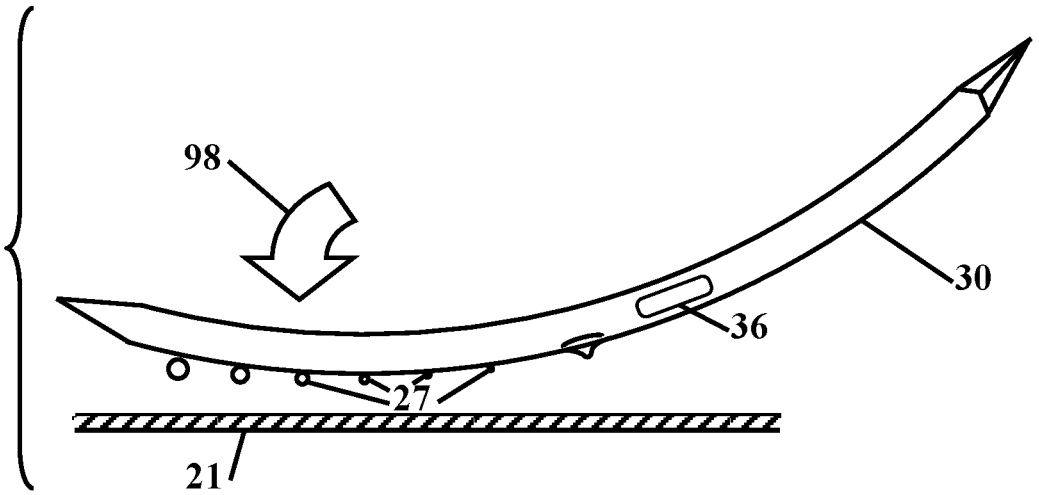
FIG. 9 shows a side of the guitar pick stick striking multiple strings with the curved surface.

FIG. 9 shows a side of the guitar pick stick 30 striking multiple strings with the curved surface. The guitar pick stick 30 is curved to allow the user to grasp the guitar pick stick 30 and strike the strings without contacting the body of the guitar with their hand as they play. The guitar pick stick 30 is shown being rotated to strike 98 the strings 27 above the guitar 21 soundboard. The guitar pick stick 30 can "bounce" on the strings 27 and within the hand of the user to produce multiple strikes. The thumb locator/recess 36 can be seen in this view.

Figure 10:
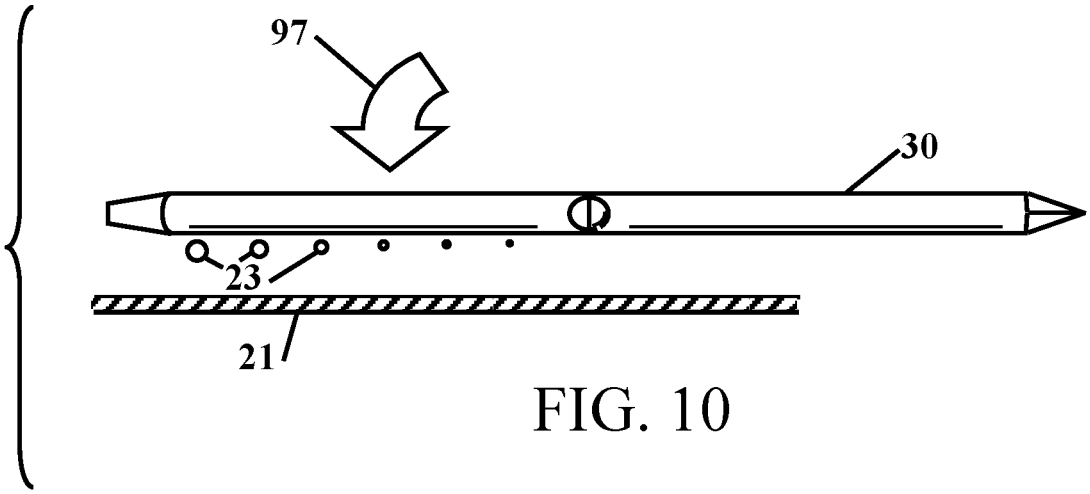
FIG. 10 shows a side of the guitar pick stick striking all of the strings with the flat side of the guitar pick stick.

FIG. 10 shows a side of the guitar pick stick 30 striking all of the strings 23 with the flat side of the guitar pick stick 30. Using this flatter side of the guitar pick stick 30, allows the performer to strike 97 the higher string, lower strings or all of the strings above the guitar 21 soundboard as shown in the figure.

Figure 11:
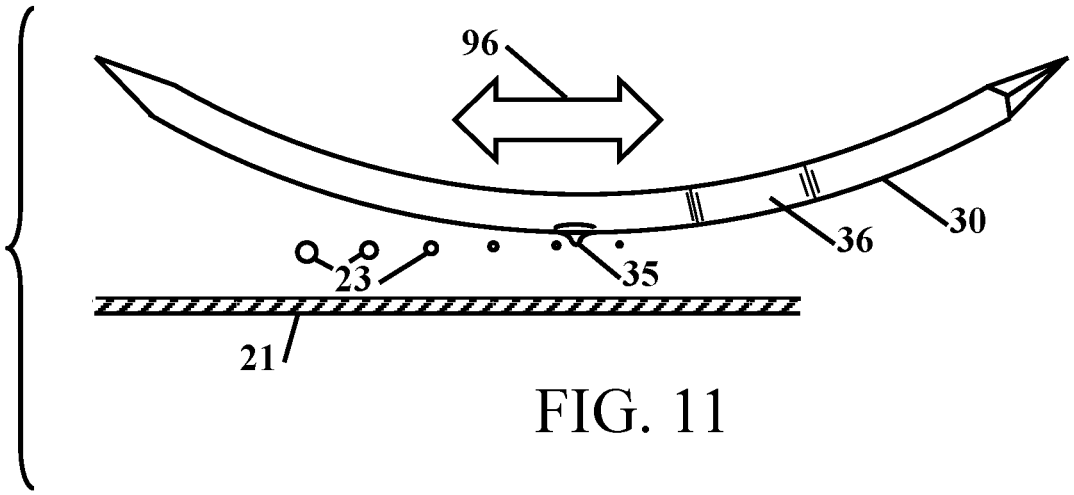
FIG. 11 shows a side of the guitar pick stick using the elevated nub.

FIG. 11 shows a side of the guitar pick stick 30 using the elevated nub 35. The elevated nub 35 can be used to rapidly or slowly be drawn side-to-side 96 across the strings 23 of the soundboard of the guitar 21 instrument to create a particular sound. As the nub 35 is drawn over a string it essentially will "pluck" the string(s) 23. The nub 35 is shown at about the center of the guitar pick stick 30 but can exist in a location that is favored to either side of the guitar pick stick 30. The thumb locator/recess 36 can be seen in this view.

Figure 12:
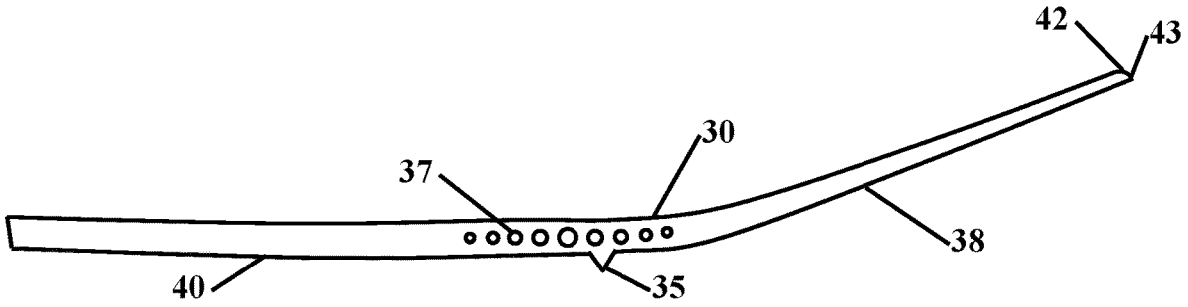
FIG. 12 shows a plan view of the guitar pick stick in a second preferred embodiment.
Figure 13:
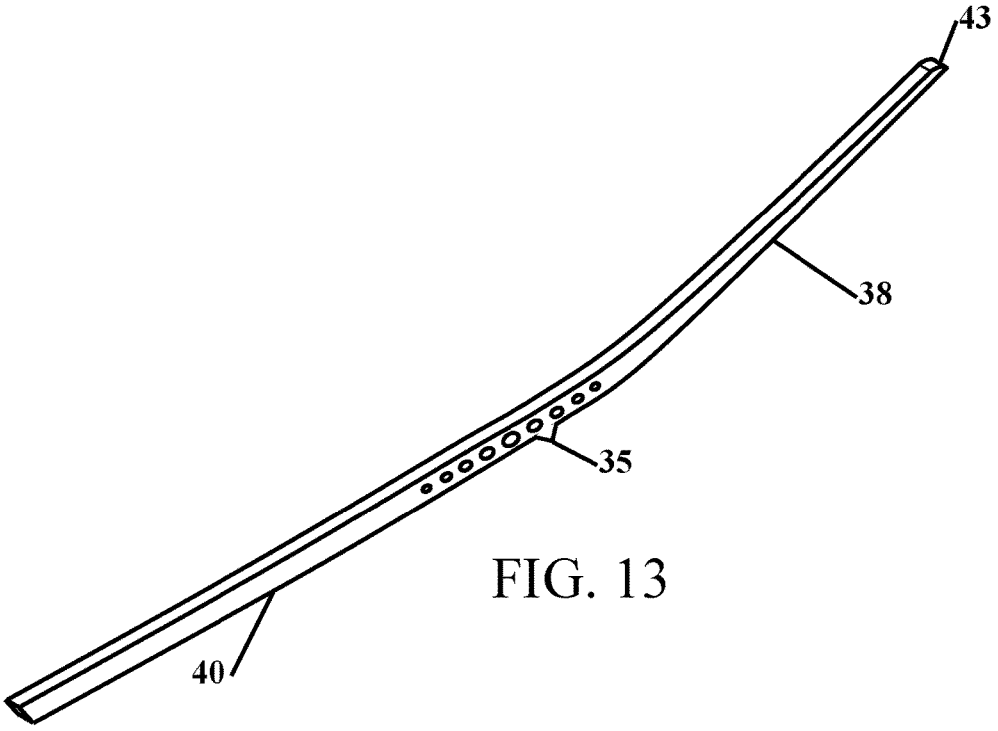
FIG. 13 shows a perspective view of the guitar pick stick in a second preferred embodiment.

FIG. 12 shows a plan view of the guitar pick stick 30 in a second preferred embodiment and FIG. 13 shows a perspective view of the guitar pick stick 30 in a second preferred embodiment. In this embodiment the guitar pick stick 30 the body is essentially flat and has a more rectangular or square cross-section as can be seen in the perspective view. In this embodiment the guitar pick stick 30 has the nub 35 for strumming the strings. A series of holes 37 above the nub 35 provide styling and also provides for a tactile feel for the center of the guitar pick stick 30. While holes 37 are shown, it is also contemplated that the holes can be replaced with raised ridges of tactile features. The flattened body 44 has a slight radius to strike multiple strings and to provide a comfortable grasp with the guitar pick stick 30 is held in the hand. The curved end 38 has a gradual taper and terminates at a tip 43 with a taper 42.

Thus, specific embodiments of a guitar pick stick have been disclosed. It should be apparent, however, to those skilled in the art that many more modifications besides those described are possible without departing from the inventive concepts herein. The inventive subject matter, therefore, is not to be restricted except in the spirit of the appended claims.

SEQUENCE LISTING

Not Applicable.

The invention claimed is:

1. A guitar pick stick comprising:

a curved shaft;

said curved shaft having a flattened area on at least half of an outer curved area of the curved shaft;

said curved shaft having at least one raised area on said outer curved surface, and said curved shaft has a gripping surface on at least one-fourth of said curved shaft.

2. The guitar pick stick according to claim 1, wherein said curved shaft is selected from the group consisting of wood, plastic or metal.

3. The guitar pick stick according to claim 1, wherein said curved shaft has a length of between 6 and 18 inches.

4. The guitar pick stick according to claim 1, wherein said curved shaft has a radius of curvature of between 6 and 18 inches.

5. The guitar pick stick according to claim 1, wherein said curved shaft has a plurality of tactile features.

6. The guitar pick stick according to claim 5, wherein said tactile features are holes.

7. The guitar pick stick according to claim 5, wherein said tactile features are raised ridges.

8. The guitar pick stick according to claim 1, wherein said guitar pick stick has an essentially round cross-section.

9. The guitar pick stick according to claim 1, wherein said guitar pick stick has an essentially rectangular cross-section.

10. The guitar pick stick according to claim 1, further includes at least one nub that extends from said curved shaft.

11. The guitar pick stick according to claim 10, wherein said nub is raised from said curved shaft from 1/16 to 3/8 of an inch.

12. The guitar pick stick according to claim 10, wherein said nub has a tapered point.

13. The guitar pick stick according to claim 10, wherein said nub has a rounded point.

14. The guitar pick stick according to claim 1, further includes at least one thumb locator.

15. The guitar pick stick according to claim 1, wherein at least one end of said curved shaft has a tapered tip.

16. The guitar pick stick according to claim 1, has a surface that is configured for striking strings of a stringed instrument.

17. The guitar pick stick according to claim 16, wherein said flattened area is configured for striking a plurality of strings simultaneously.

18. The guitar pick stick according to claim 1, wherein at least one side of said curved shaft is flat.

19. The guitar pick stick according to claim 1, wherein said guitar pick stick has a diameter of between 1/4 inch to 3/4 inch.

20. The guitar pick stick according to claim 1, wherein one or more side of said curved shaft are scalloped.

* * * * *